US007178958B2

(12) United States Patent
Matsumoto et al.

(10) Patent No.: US 7,178,958 B2
(45) Date of Patent: Feb. 20, 2007

(54) VEHICLE LIGHT

(75) Inventors: Kazuhiro Matsumoto, Isehara (JP); Masafumi Kobayashi, Isehara (JP); Kazunori Iwasaki, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 147 days.

(21) Appl. No.: 11/000,518

(22) Filed: Dec. 1, 2004

(65) Prior Publication Data

US 2005/0141233 A1 Jun. 30, 2005

(30) Foreign Application Priority Data

Dec. 1, 2003 (JP) ..... 2003-402125

(51) Int. Cl.
*F21V 101/10* (2006.01)

(52) U.S. Cl. ..... 362/517; 362/516; 362/304; 362/346; 362/211; 362/215

(58) Field of Classification Search ..... 362/346, 362/350, 297, 304, 517, 516, 518, 507, 211, 362/215

See application file for complete search history.

(56) References Cited

U.S. PATENT DOCUMENTS

| | | | | |
|---|---|---|---|---|
| 5,130,900 | A | 7/1992 | Makita | |
| 5,178,452 | A * | 1/1993 | Scholz | 362/319 |
| 6,068,388 | A * | 5/2000 | Walker et al. | 362/304 |
| 2004/0165388 | A1 * | 8/2004 | Shoji | 362/304 |

FOREIGN PATENT DOCUMENTS

| | | |
|---|---|---|
| DE | 196 32 189 A1 | 2/1998 |
| EP | 1 434 001 A2 | 6/2004 |
| JP | 4-18406 B2 | 3/1992 |
| JP | 2504584 Y2 | 4/1996 |
| JP | 2527274 B2 | 6/1996 |

* cited by examiner

*Primary Examiner*—Laura K. Tso
(74) *Attorney, Agent, or Firm*—Foley & Lardner LLP

(57) ABSTRACT

A vehicle light includes a light source, a main-reflector, and a sub-reflector. The sub-reflector is arranged around the light source. The main-reflector is arranged around the light source and the sub-reflector. The main-reflector includes a reflection surface that reflects light from the light source in a predetermined direction, avoiding the sub-reflector.

9 Claims, 9 Drawing Sheets

VEHICLE LIGHT

BACKGROUND OF THE INVENTION

1) Field of the Invention

The present invention relates to a vehicle light that includes a light source, a main-reflector, and a sub-reflector. In the specification, "road surface and the like" includes the road surface, persons (pedestrians, etc.) on a road, and objects (other vehicles, traffic signs, buildings, etc.) on the road.

2) Description of the Related Art

There is conventionally a vehicle light of this type (see, for example, Japanese Patent Application Laid-Open Publication No. H4-18406, Japanese Utility-Model Registration No. 2504584, and Japanese Patent No. 2527274). This conventional vehicle light will be explained below. Reference numerals in brackets respectively correspond to those in Japanese Patent Application Laid-Open Publication No. H4-18406, Japanese Utility-Model Registration No. 2504584, and Japanese Patent No. 2527274. The conventional vehicle light has a light source (4, 24, 24), a main-reflector (2, 22, 22), and a sub-reflector (5, 30, 30).

The action of the conventional vehicle light will be explained below. First, the light source (4, 24, 24) is lighted. The light from the light source (4, 24, 24) is reflected by the main-reflector (2, 22, 22) and the sub-reflector (5, 30, 30). The reflected light from the main-reflector (2, 22, 22) and the reflected light from the sub-reflector (5, 30, 30) illuminate the road surface and the like in a predetermined light distribution pattern.

The conventional vehicle light can reflect the light from the light source (4, 24, 24) by the main-reflector (2, 22, 22) and the sub-reflector (5, 30, 30) and effectively use the reflected light. Therefore, the conventional vehicle light can miniaturize (decreasing the sizes in the back and forth direction, in the horizontal direction, and in the vertical direction), and improve the irradiation luminous intensity (irradiation illuminance and amount of irradiation light). The conventional vehicle light, however, has a problem in that it does not take into consideration realization of both of the effective use of the reflected light from the main-reflector (2, 22, 22), and prevention of glare.

SUMMARY OF THE INVENTION

It is an object of the present invention to solve at least the above problems in the conventional technology.

A vehicle light according to one aspect of the present invention includes a light source, a main-reflector, and a sub-reflector. The sub-reflector is arranged around the light source. The main-reflector is arranged around the light source and the sub-reflector. The main-reflector includes a reflection surface that reflects light from the light source in a predetermined direction, avoiding the sub-reflector.

The other objects, features, and advantages of the present invention are specifically set forth in or will become apparent from the following detailed description of the invention when read in conjunction with the accompanying drawings.

DETAILED DESCRIPTION

Figure 1:
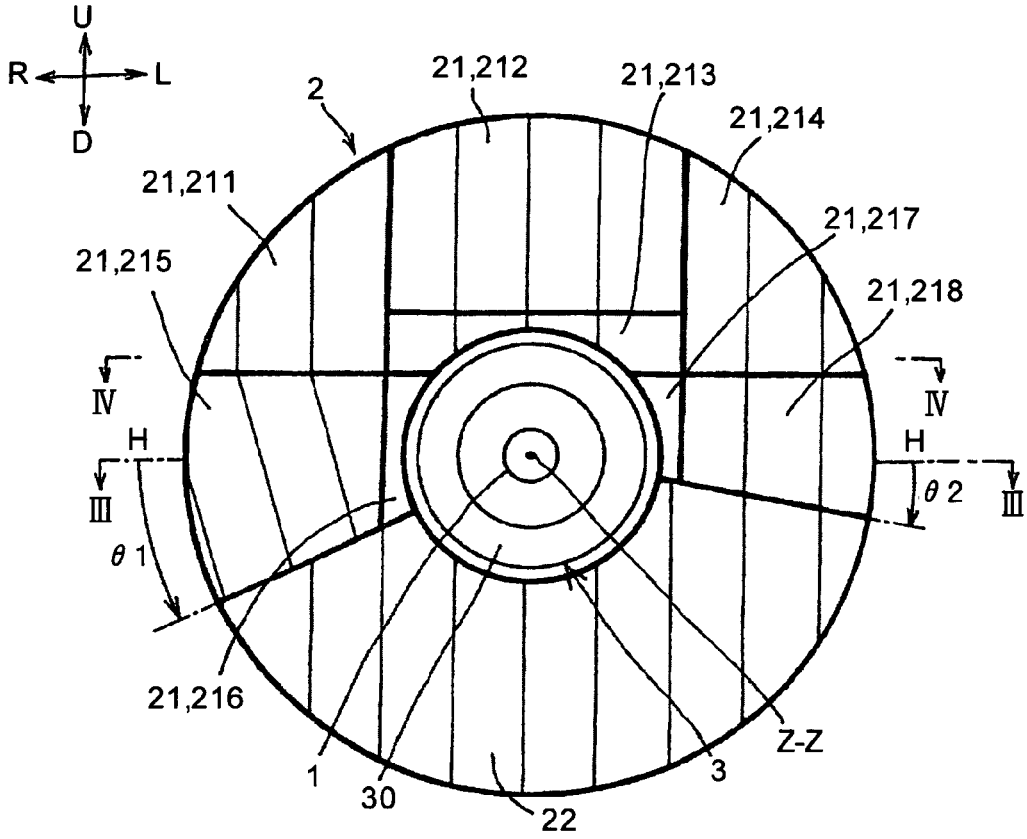
FIG. 1 is an elevation view of a light source, a main-reflector, and a sub-reflector of a vehicle light according to a first embodiment of the present invention.

Exemplary embodiments of a vehicle light according to the present invention will be explained in detail with reference to the accompanying drawings. A headlight of a car will be explained as an example. Note that, in schematic diagrams shown in FIGS. 3, 4, 15, 18, and 19, a hatching is omitted. The present invention is not limited to these embodiments. In the drawings, reference sign "F" denotes the front side (traveling direction) of a car C. Reference sign "B" denotes the backside of the car C. Reference sign "U" denotes upward when a driver sees the front. Reference sign "D" denotes downward when the driver sees the front. Reference sign "L" denotes the left side when the driver sees the front. Reference sign "R" denotes the right side when the driver sees the front. Reference sign "VU-VD" denotes a vertical line on a screen. Reference sign "HL-HR" denotes a horizontal line on the screen. Reference sign "Z-Z" denotes an optical axis.

FIGS. 1 to 13 depict a vehicle light according a first embodiment of the present invention. The configuration of the vehicle light in the first embodiment will be explained below. Respective light distribution patterns P1, P2, P3, P4, P5, P6, P7, and P8 shown in FIG. 2 and FIGS. 5 to 12, and a low-beam light distribution pattern LP shown in FIG. 13 are light distribution patterns when the driving lane is on the left side. Therefore, the light distribution patterns when the driving lane is on the right side are symmetric (reversed from left to right) to the light distribution patterns shown in FIG. 2, FIGS. 5 to 12, and FIG. 13.

The vehicle light in the first embodiment has a light source 1, a main-reflector 2, and a sub-reflector 3. The light source 1, the main-reflector 2, and the sub-reflector 3 are respectively arranged in a lamp chamber (not shown) sectioned by a lamp housing (not shown) and a lamp lens (not shown). The sub-reflector 3 is arranged around the light source 1. The main-reflector 2 is arranged around the light source 1 and the sub-reflector 3.

The light source 1 has a main-filament (not shown) and a sub-filament (not shown).

The main-reflector 2 has, as shown in FIG. 1, a substantially circular shape as seen from the front. At substantially the center of the main-reflector 2, a substantially circular through-hole 20 is provided, through which the light source 1 is inserted. The main-reflector 2 is formed of a first reflection surface 21 and a second reflection surface 22 (a range surrounded by thick solid lines in FIG. 1). A borderline between the first reflection surface 21 and the second reflection surface 22 is, as shown in FIG. 1, a borderline with the right side being at a turning angle θ1 (25°±5°) downward with respect to a horizontal line H-H, and with the left side being at a turning angle θ2 (10°±5°) downward with respect to the horizontal line H-H.

The first reflection surface 21 reflects light from the sub-filament as a low beam, by which the low-beam light distribution pattern LP (see FIG. 13) can be obtained, and reflects light from the main-filament as a high beam (not shown), by which a high-beam light distribution pattern can be obtained. On the other hand, the second reflection surface 22 reflects light from the main-filament as a high beam, by which a high-beam light distribution pattern can be obtained. The first reflection surface 21 and the second reflection surface 22 are designed for light distribution so that the reflected light from the main-reflector 2 does not shine onto the sub-reflector 3, and more particularly, onto the backside of the sub-reflector 3.

The first reflection surface is largely divided into reflection surfaces in zones close to the light source 1 and the sub-reflector 3, and reflection surfaces in zones away from the light source 1 and the sub-reflector 3. The first reflection surface 21 is finely divided into eight zones (zones surrounded by thick solid lines in FIG. 1), that is, a reflection surface 211 in a first zone, a reflection surface 212 in a second zone, a reflection surface 213 in a third zone, a reflection surface 214 in a fourth zone, a reflection surface 215 in a fifth zone, a reflection surface 216 in a sixth zone, a reflection surface 217 in a seventh zone, and a reflection surface 218 in an eighth zone.

The reflection surface 213 in the third zone, the reflection surface 216 in the sixth zone, and the reflection surface 217 in the seventh zone are reflection surfaces in the zones close to the light source 1 and the sub-reflector 3. On the other hand, the reflection surface 211 in the first zone, the reflection surface 212 in the second zone, the reflection surface 214 in the fourth zone, the reflection surface 215 in the fifth zone, and the reflection surface 218 in the eighth zone are reflection surfaces in the zones away from the light source 1 and the sub-reflector 3.

The reflection surfaces 211 to 218 in the respective zones on the first reflection surface 21 and the second reflection surface 22 are respectively formed of one or a plurality of segments. For example, the reflection surface 211 in the first zone includes three segments, the reflection surface 212 in the second zone includes four segments, the reflection surface 213 in the third zone includes four segments, the reflection surface 214 in the fourth zone includes three segments, the reflection surface 215 in the fifth zone includes three segments, the reflection surface 216 in the sixth zone includes one segment, the reflection surface 217 in the seventh zone includes one segment, the reflection surface 218 in the eighth zone includes three segments, and the second reflection surface 22 includes nine segments. The segments are divided horizontally.

Figure 5:
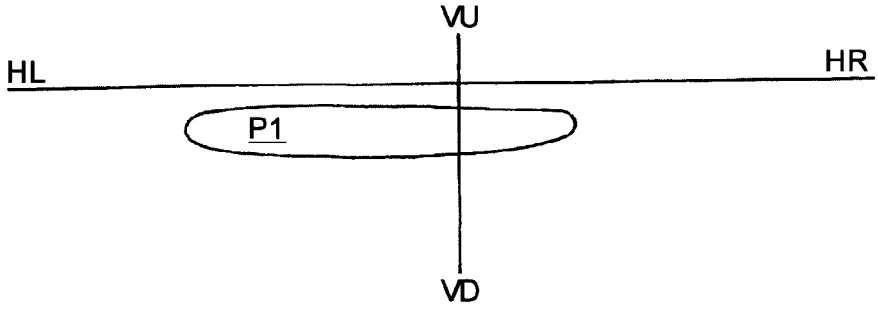
FIG. 5 is an explanatory diagram of a light distribution pattern obtained by the reflection surface in a first zone on the first reflection surface.

The reflection surface 211 in the first zone reflects light from the sub-filament in a predetermined direction, thereby obtaining a substantially centralized light distribution pattern P1 shown in FIG. 5. The light distribution pattern P1 is a substantially centralized light distribution pattern P1, with the upper edge thereof substantially agreeing with the upper edge of the low-beam light distribution pattern LP, having a small vertical width, and a horizontal width slightly largely protruding to the left side from a vertical line VU-VD on a screen, and slightly protruding to the right side.

Figure 6:
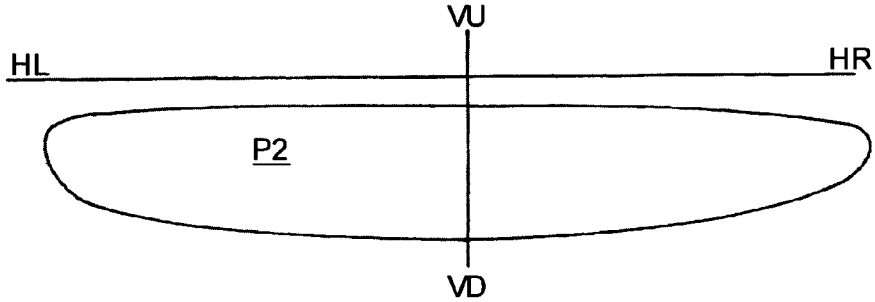
FIG. 6 is an explanatory diagram of a light distribution pattern obtained by the reflection surface in a second zone on the first reflection surface.

The reflection surface 212 in the second zone reflects light from the sub-filament in a predetermined direction, thereby obtaining a diffused light-distribution-pattern P2 shown in FIG. 6. The light distribution pattern P2 is a diffused light-distribution-pattern P2, with the upper edge thereof substantially agreeing with the upper edge of the low-beam light distribution pattern LP, having a large vertical width, and a horizontal width largely protruding to the right and left sides from the vertical line VU-VD on the screen.

Figure 4:
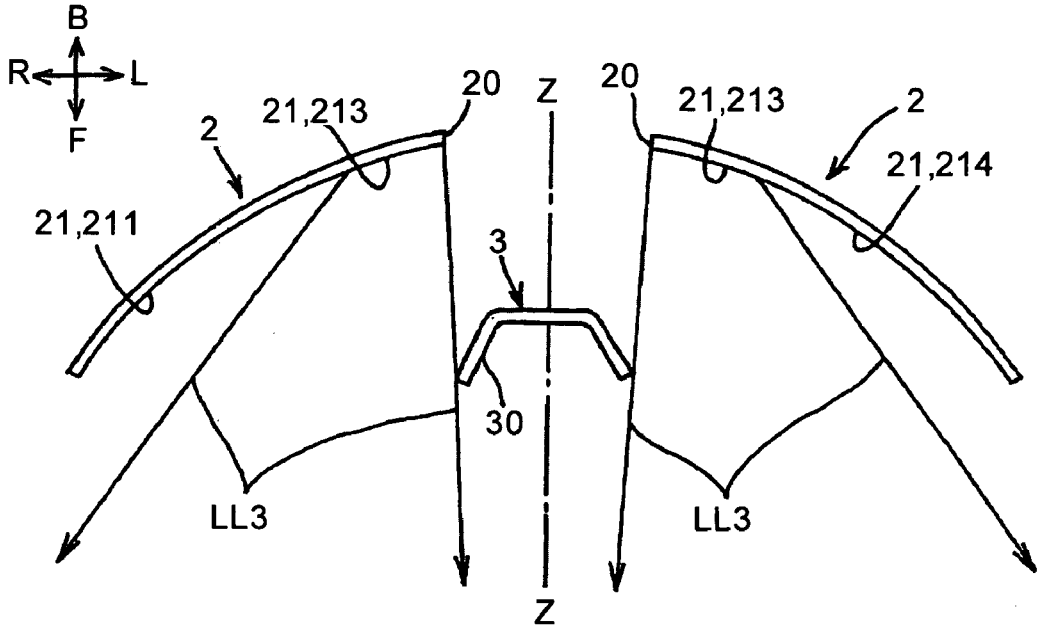
FIG. 4 is a cross section along line IV—IV in FIG. 1.
Figure 7:
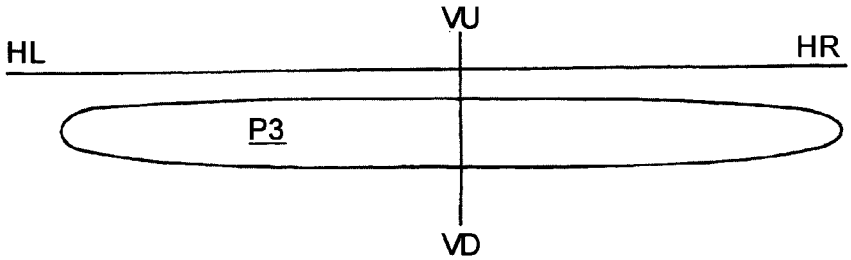
FIG. 7 is an explanatory diagram of a light distribution pattern obtained by the reflection surface in a third zone on the first reflection surface.

The reflection surface 213 in the third zone, as shown in FIG. 4, reflects light from the sub-filament in a predetermined direction as a low beam LL3, avoiding the sub-reflector 3, thereby obtaining a diffused light-distribution-pattern P3 shown in FIG. 7. The light distribution pattern P3 is a diffused light-distribution-pattern P3, with the upper edge thereof substantially agreeing with the upper edge of the low-beam light distribution pattern LP, having a small vertical width, and a horizontal width largely protruding to the right and left sides from the vertical line VU-VD on the screen.

Figure 8:
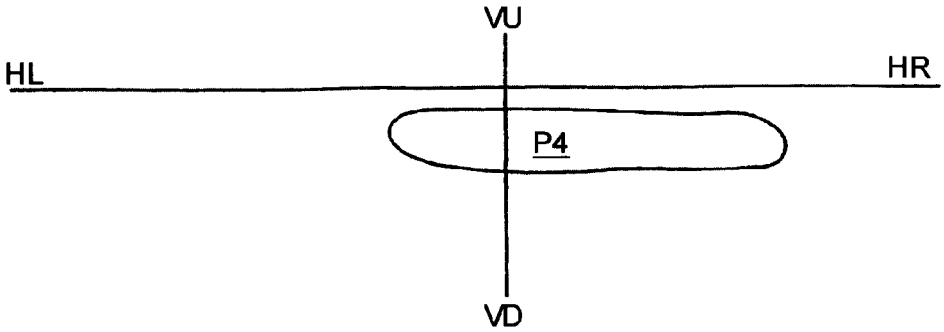
FIG. 8 is an explanatory diagram of a light distribution pattern obtained by the reflection surface in a fourth zone on the first reflection surface.

The reflection surface 214 in the fourth zone reflects light from the sub-filament in a predetermined direction, thereby obtaining a substantially centralized light distribution pattern P4 shown in FIG. 8. The light distribution pattern P4 is a substantially centralized light distribution pattern P4, with the upper edge thereof substantially agreeing with the upper edge of the low-beam light distribution pattern LP, having a small vertical width, and a horizontal width slightly largely protruding to the right side from the vertical line VU-VD on the screen, and slightly protruding to the left side.

Figure 9:
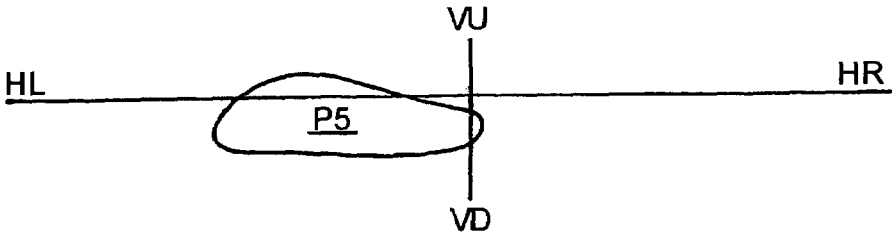
FIG. 9 is an explanatory diagram of a light distribution pattern obtained by the reflection surface in a fifth zone on the first reflection surface.

The reflection surface 215 in the fifth zone reflects light from the sub-filament in a predetermined direction, thereby obtaining a substantially centralized light distribution pattern P5 shown in FIG. 9. The light distribution pattern P5 is a substantially centralized light distribution pattern P5 that forms a triangular cutline on a driving lane side of the low-beam light distribution pattern LP, with the upper edge thereof substantially agreeing with the upper edge of the low-beam light distribution pattern LP, and having a slightly small vertical width, and a horizontal width slightly largely protruding to the left side from the vertical line VU-VD on the screen, and slightly protruding to the right side.

Figure 3:
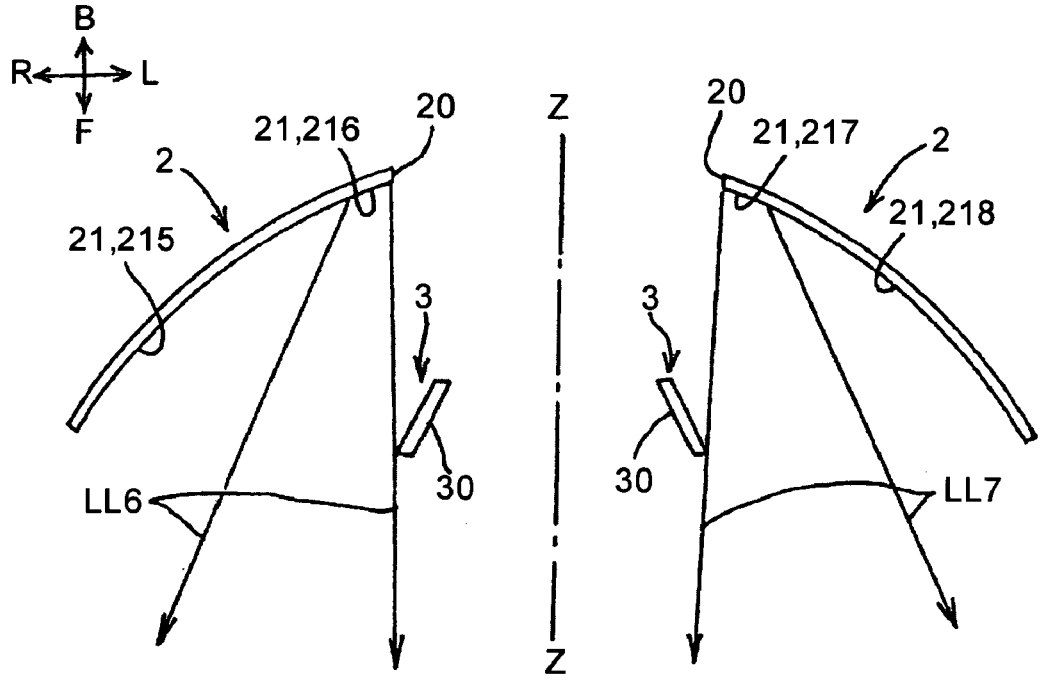
FIG. 3 is a cross section along line III—III in FIG. 1.
Figure 10:
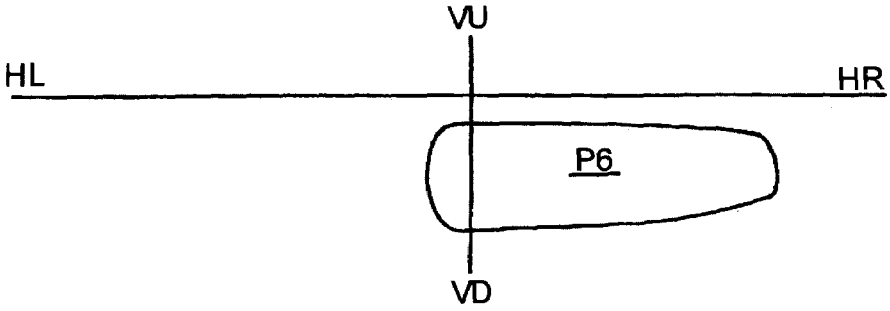
FIG. 10 is an explanatory diagram of a light distribution pattern obtained by the reflection surface in a sixth zone on the first reflection surface.

The reflection surface 216 in the sixth zone, as shown in FIG. 3, reflects light from the sub-filament in a predetermined direction as a low beam LL6, avoiding the sub-reflector 3, thereby obtaining a substantially diffused light-distribution-pattern P6 shown in FIG. 10. The light distribution pattern P6 is a substantially diffused light-distribution-pattern P6, with the upper edge thereof substantially agreeing with the upper edge of the low-beam light distribution pattern LP, having a slightly large vertical width, and a horizontal width slightly largely protruding to the right side from the vertical line VU-VD on the screen, and slightly protruding to the left side.

Figure 11:
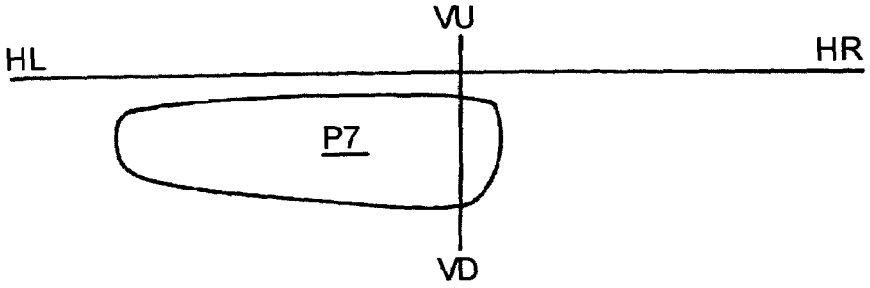
FIG. 11 is an explanatory diagram of a light distribution pattern obtained by the reflection surface in a seventh zone on the first reflection surface.

The reflection surface 217 in the seventh zone, as shown in FIG. 3, reflects light from the sub-filament in a predetermined direction as a low beam LL7, avoiding the sub-reflector 3, thereby obtaining a substantially diffused light-distribution-pattern P7 shown in FIG. 11. The light distribution pattern P7 is a substantially diffused light-distribution-pattern P7, with the upper edge thereof substantially agreeing with the upper edge of the low-beam light distribution pattern LP, having a slightly large vertical width, and a horizontal width slightly largely protruding to the left side from the vertical line VU-VD on the screen, and slightly protruding to the right side.

Figure 12:
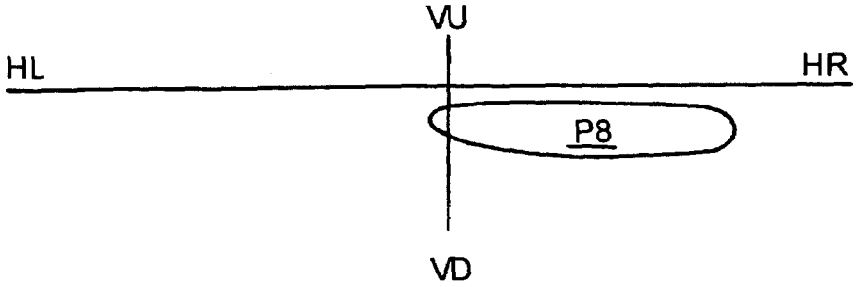
FIG. 12 is an explanatory diagram of a light distribution pattern obtained by the reflection surface in an eighth zone on the first reflection surface.
Figure 13:
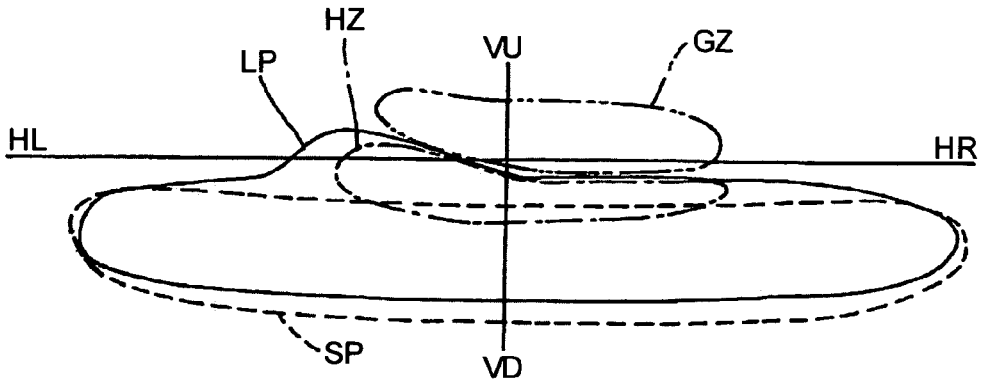
FIG. 13 is an explanatory diagram of a low-beam light distribution pattern obtained by the first reflection surface of the main-reflector, and a supplementary light distribution pattern obtained by the reflection surface of the sub-reflector.

The reflection surface 218 in the eighth zone reflects light from the sub-filament in a predetermined direction, thereby obtaining a substantially centralized light distribution pattern P8 shown in FIG. 12. The light distribution pattern P8 is a substantially centralized light distribution pattern P8 that forms a horizontal cutline on an opposing lane side of the low-beam light distribution pattern LP, with the upper edge thereof substantially agreeing with the upper edge of the low-beam light distribution pattern LP, and having a small vertical width, and a horizontal width slightly largely protruding to the right side from the vertical line VU-VD on the screen, and slightly protruding to the left side.

Figure 2:
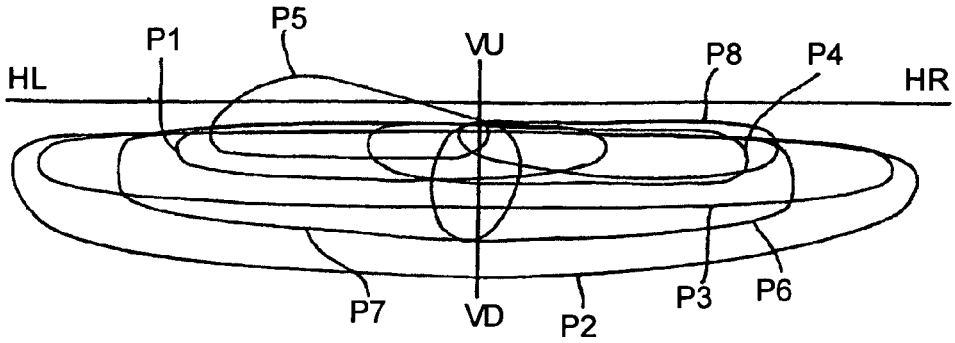
FIG. 2 is an explanatory diagram of a state in which light distribution patterns obtained by reflection surfaces in respective zones on a first reflection surface are combined.

By combining the respective light distribution patterns P1 to P8 obtained by the reflection surfaces 211 to 218 in the respective zones on the first reflection surface 21 as shown in FIG. 2, the low-beam light distribution pattern LP as shown by a solid line in FIG. 13 can be obtained.

The light source 1 and the sub-reflector 3 are arranged close to each other, as shown in FIG. 1. That is, the light source 1 is inserted into and arranged in the sub-reflector 3. The sub-reflector 3 has a cylindrical cone-shape. A reflection surface 30 is formed on the inner face of the sub-reflector 3. A supplementary light distribution pattern SP obtained by the reflection surface 30 of the sub-reflector 3 is, as shown by a broken line in FIG. 13, in a curved shape with respect to a high luminous intensity zone HZ (or a hot zone HZ shown by a one-dot chain line in FIG. 13) at the upper edge of the low-beam light distribution pattern LP obtained by the first reflection surface 21 of the main-reflector 2, with the central part recessed downward, and the one end and the other end portions protruding upward.

The vehicle light in the first embodiment has the above configuration, and the action thereof will be explained below.

The sub-filament of the light source is first lighted. The light from the sub-filament is then reflected by the reflection surfaces 211 to 218 in the respective zones on the first reflection surface 21 of the main-reflector 2. The reflected light illuminates the road surface and the like in the predetermined light distribution patterns P1 to P8 shown in FIGS. 5 to 12.

That is, the reflected light from the reflection surface 211 in the first zone illuminates the road surface and the like in the predetermined light distribution pattern P1 shown in FIG. 5. The reflected light from the reflection surface 212 in the second zone illuminates the road surface and the like in the predetermined light distribution pattern P2 shown in FIG. 6. The reflected light from the reflection surface 213 in the third zone illuminates the road surface and the like in the predetermined light distribution pattern P3 shown in FIG. 7 with the low beam LL3 shown in FIG. 4, avoiding the sub-reflector 3. The reflected light from the reflection surface 214 in the fourth zone illuminates the road surface and the like in the predetermined light distribution pattern P4 shown in FIG. 8. The reflected light from the reflection surface 215 in the fifth zone illuminates the road surface and the like in the predetermined light distribution pattern P5 shown in FIG. 9. The reflected light from the reflection surface 216 in the sixth zone illuminates the road surface and the like in the predetermined light distribution pattern P6 shown in FIG. 10 with the low beam LL6 shown in FIG. 3, avoiding the sub-reflector 3. The reflected light from the reflection surface 217 in the seventh zone illuminates the road surface and the like in the predetermined light distribution pattern P7 shown in FIG. 11 with the low beam LL7 shown in FIG. 3, avoiding the sub-reflector 3. The reflected light from the reflection surface 218 in the eighth zone illuminates the road surface and the like in the predetermined light distribution pattern P8 shown in FIG. 12. By combining the respective light distribution patterns P1 to P8 obtained by the reflection surfaces 211 to 218 in the respective zones as shown in FIG. 2, the predetermined low-beam light distribution pattern LP as shown by the solid line in FIG. 13 can be obtained.

The light from the sub-filament is reflected by the reflection surface 30 of the sub-reflector 3. The reflected light illuminates the road surface and the like in the supplementary light distribution pattern SP shown by the broken line in FIG. 13.

On the other hand, the main-filament of the light source is lighted. The light from the main-filament is then reflected by the reflection surfaces 211 to 218 in the respective zones on the first reflection surface 21 of the main-reflector 2, and the second reflection surface 22. The reflected light illuminates the road surface and the like in the predetermined high-beam light distribution pattern. The light from the main-filament is reflected by the reflection surface 30 of the sub-reflector 3. The reflected light illuminates the road surface and the like in the predetermined supplementary light distribution pattern.

Thus, the vehicle light in the first embodiment can effectively use the light from the sub-filament of the light source 1 by reflecting the light on the reflection surfaces 211 to 218 in the respective zones on the first reflection surface 21 of the main-reflector 2, and the reflection surface 30 of the sub-reflector 3. The vehicle light in the first embodiment can also effectively use the light from the main-filament of the light source 1 by reflecting the light on the reflection surfaces 211 to 218 in the respective zones on the first reflection surface 21 of the main-reflector 2, the second reflection surface 22, and the reflection surface 30 of the sub-reflector 3. Therefore, the vehicle light in the first embodiment can miniaturize (decreasing the sizes in the back and forth direction, in the horizontal direction, and in the vertical direction), and improve the irradiation luminous intensity (irradiation illuminance and amount of irradiation light).

The vehicle light in the first embodiment has the above configuration and action, and the effect thereof will be explained below.

The vehicle light in the first embodiment can reflect the light from the sub-filament or the light from the main-filament of the light source 1 in the predetermined direction by the reflection surfaces 211 to 218 in the respective zones on the first reflection surface 21 of the main-reflector 2, and hence, can effectively use the light from the sub-filament or the light from the main-filament of the light source 1. The vehicle light in the first embodiment can reflect the light from the sub-filament of the light source, avoiding the sub-reflector 3, by the reflection surfaces on the first reflection surface 21 of the main-reflector 2, in the zones close to the light source 1 and the sub-reflector 3, that is, by the reflection surface 213 in the third zone, the reflection surface 216 in the sixth zone, and the reflection surface 217 in the seventh zone. As a result, glare due to the reflected light from the main-reflector reflected on the sub-reflector, which causes loss of control of the light distribution, can be prevented. Thus, the vehicle light in the first embodiment can realize both the effective use of the reflected light from the main-reflector 2, and prevention of glare.

Particularly, in the vehicle light in the first embodiment, since the reflected light from the main-reflector 2 does not shine on the sub-reflector 3, it is not necessary to treat the backside of the sub-reflector 3 in black in order to prevent glare. As a result, in the vehicle light in the first embodiment, the backside of the sub-reflector 3 can be subjected to the surface treatment same as that for the reflection surface 30 on the front side, for example, aluminum evaporation or silver plating. Hence, the treatment step becomes simple, as compared with the one in which the backside of the sub-reflector is treated in black, thereby reducing the production cost. Since the backside of the sub-reflector 3 is not involved in the light distribution design, the backside of the sub-reflector 3 can be colored other than black, for example, blue or orange. When the main-filament and the sub-filament are not lighted, this color is projected on the reflection surface of the main-reflector, which improves the appearance, rather than the black being projected.

The above effect can be obtained even by a vehicle light using a so-called single-filament light source or a discharge lamp, other than the so-called double-filament light source 1 having the main-filament and the sub-filament.

In the vehicle light in the first embodiment, the light from the sub-filament is reflected in a predetermined direction, avoiding the sub-reflector 3, by the reflection surface 213 in the third zone, the reflection surface 216 in the sixth zone, and the reflection surface 217 in the seventh zone on the first reflection surface 21 of the main-reflector 2. Hence, in the low-beam light distribution pattern LP, the diffused light-distribution-pattern P3 in which the horizontal width largely protrudes to the right and left sides from the vertical line VU-VD on the screen, the substantially diffused light-distribution-pattern P6 in which the horizontal width slightly largely protrudes to the right side from the vertical line VU-VD on the screen, and slightly protrudes to the left side, and the substantially diffused light-distribution-pattern P7 in which the horizontal width slightly largely protrudes to the left side from the vertical line VU-VD on the screen, and slightly protrudes to the right side can be formed. As a result, in the vehicle light in the first embodiment, there is no nonuniformity in the light distribution in the low-beam light distribution pattern LP, and flexibility in the light distribution design of the low-beam light distribution pattern LP can be increased, by the diffused or substantially diffused light-distribution-patterns P3, P6, and P7.

Further, in the vehicle light in the first embodiment, the supplementary light distribution pattern SP obtained by the reflection surface 30 of the sub-reflector 3 has a shape as shown by the broken line in FIG. 13, that is, forms a curved shape with the central part recessed downward, and the one end and the other end portions protruding upward. Therefore, in the vehicle light in the first embodiment, even if there is a difference in the assembly of the light source 1 and the sub-reflector 3, and blurring occurs in the supplementary light distribution pattern SP obtained by the reflection surface 30 of the sub-reflector 3, the upper edge of the supplementary light distribution pattern SP comes out upward than the high luminous intensity zone HZ at the upper edge of the low-beam light distribution pattern LP, thereby preventing glare GZ shown by a two-dot chain line in FIG. 13. That is, in the vehicle light in which the light source and the sub-reflector are arranged close to each other, if there is a difference in the assembly of the light source and the sub-reflector, even if the difference is small, blurring in the supplementary light distribution pattern obtained by the reflection surface of the sub-reflector increases, thereby causing glare. In the vehicle light in the first embodiment, however, since the supplementary light distribution pattern SP obtained by the reflection surface 30 of the sub-reflector 3 has the above described shape, even if there is some blurring in the supplementary light distribution pattern SP, glare GZ can be prevented. As a result, the vehicle light in the first embodiment can prevent glare GZ, and since the assembly precision of the light source 1 and the sub-reflector 3 is not necessarily required to be high, the assembly work can be simplified, thereby improving the assembly work efficiency, and reducing the production cost.

Figure 14:
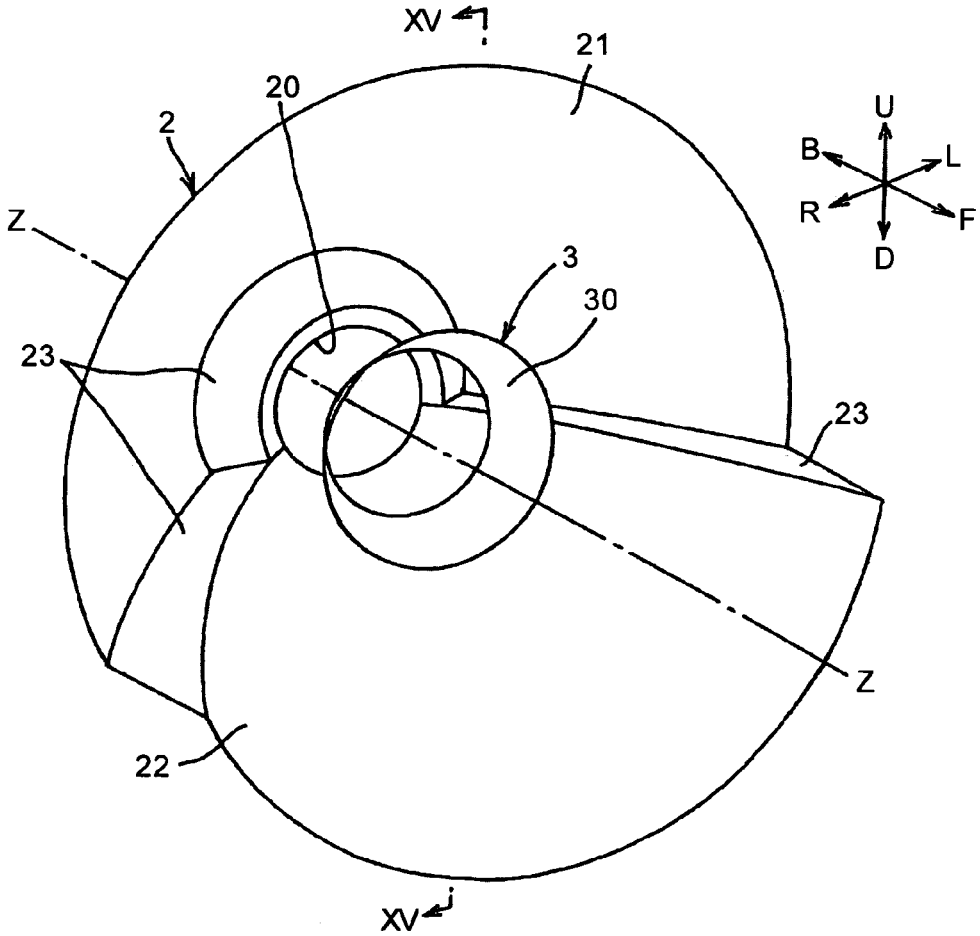
FIG. 14 is a perspective view of a main-reflector and a sub-reflector of a vehicle light according to a second embodiment of the present invention.
Figure 15:
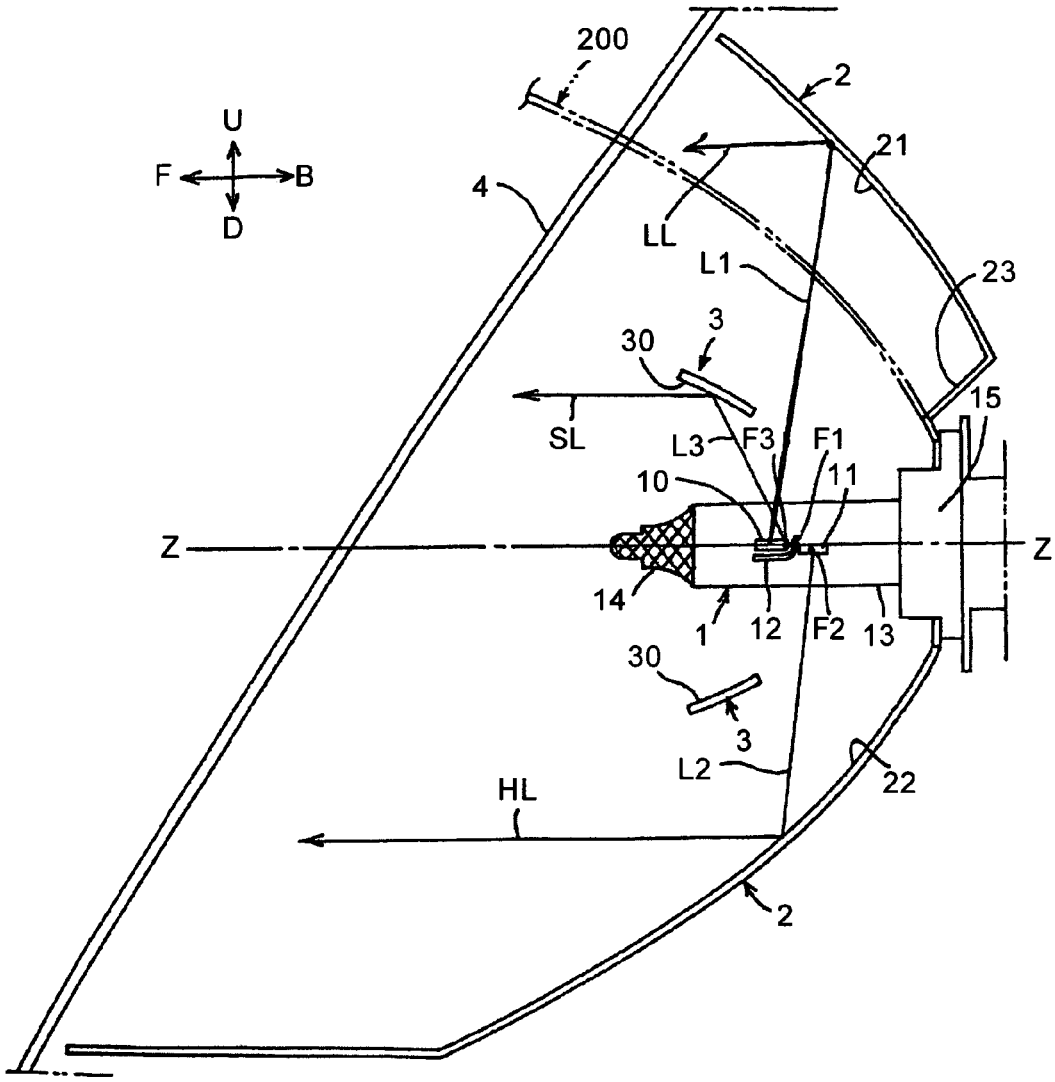
FIG. 15 is a cross section along line XV—XV in FIG. 14.
Figure 16:
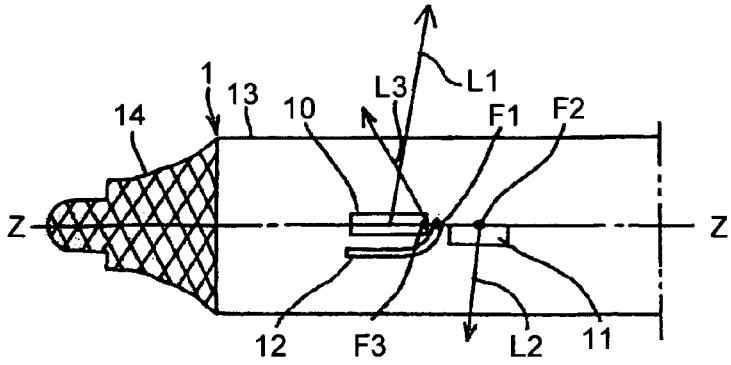
FIG. 16 is a partially enlarged side view of a light source, in which respective focal points are shown.

FIGS. 14 to 16 depict a vehicle light according a second embodiment of the present invention. The vehicle light in the second embodiment will be explained next. In the drawings, like reference signs designate like parts as those in FIGS. 1 to 13.

The light source 1 of the vehicle light in the second embodiment has a sub-filament 10, a main-filament 11, and a shade 12. The sub-filament 10, the main-filament 11, and the shade 12 are arranged back and forth on an optical axis (main optical axis) Z-Z. The center of axis of the sub-filament 10 substantially agrees with the optical axis Z-Z. The upper edge of the main-filament 11 substantially agrees with the optical axis Z-Z. The shade 12 covers the sub-filament 10 from the lower side to the rear end thereof. The sub-filament 10, the main-filament 11, and the shade 12 are sealed in a glass bulb 13. A black top portion 14 (black head portion), for example, painted in black, which cuts off the direct light from the sub-filament 10 and the direct light from the main-filament 11, is provided at the front end of the glass bulb 13. On the other hand, a cap portion 15 for detachably fitting the light source 1 to the main-reflector 2 is provided at the rear end of the glass bulb 13.

The main-reflector 2 of the vehicle light in the second embodiment includes the first reflection surface 21, the second reflection surface 22, and a stepped surface 23 arranged between the first reflection surface 21 and the second reflection surface 22. The focal length of the first reflection surface 21 is larger than that of the second reflection surface 22.

The first reflection surface 21 is formed of a reflection surface using as a base a paraboloid designating a substantial midpoint F1 between the sub-filament 10 and the main-filament 11 as a focal point (a first focal point F1). The first reflection surface 21 reflects light L1 from the sub-filament 10 as a low beam LL, by which the low-beam light distribution pattern LP (see FIGS. 2 and 13) can be obtained, and reflects light (not shown) from the main-filament 11 as a high beam (not shown), by which a high-beam light distribution pattern (not shown) can be obtained.

The second reflection surface 22 is formed of a reflection surface using as a base a paraboloid designating a substantial central point F2 of the main-filament 11 as a focal point (a second focal point F2). The second reflection surface 22 reflects light L2 from the main-filament 11 as a high beam HL, by which the high-beam light distribution pattern (not shown) can be obtained. The light from the sub-filament 10 can not enter into the second reflection surface 22 due to the blocking action of the shade 12.

On the sub-reflector 3, the reflection surface 30 using as a base a paraboloid designating a point F3 at an end (a rear end) of the sub-filament 10 closer to the main-filament 11 as a focal point (a third focal point F3) is formed. The reflection surface 30 reflects light L3 from the sub-filament 10 as a supplementary beam SL, by which the supplementary light distribution pattern SP (see FIG. 13) can be obtained, and light (not shown) from the main-filament 11 as a supplementary beam (not shown), by which the supplementary light distribution pattern (not shown) can be obtained.

Since the vehicle light in the second embodiment has the above configuration, similar action and effect to those of the vehicle light in the first embodiment can be achieved.

Particularly, in the vehicle light in the second embodiment, since the focal length of the first reflection surface 21 is made larger than that of the second reflection surface 22, the area of the first reflection surface 21 can be made wider, and hence, the luminous intensity (illuminance and amount of light) of the low-beam light distribution pattern LP can be increased, thereby improving the light distribution performance.

In the vehicle light in the second embodiment, even when the focal length of the first reflection surface 21 is made larger than that of the second reflection surface 22, by the stepped surface 23 provided between the first reflection surface 21 and the second reflection surface 22 to enlarge the area of the first reflection surface 21, the depth in the back and forth direction (F-B) of the lamp can be made small, as compared with a main-reflector 200 in which a step is not provided (a main-reflector shown by a two-dot chain line in FIG. 15). That is, if the area of the main-reflector 200 with no step is increased, as shown in FIG. 15, the main-reflector 200 and the lamp lens (or an outer lens) 4 of the vehicle light interferes with each other. In order to avoid the mutual intervention of the main-reflector 200 and the lamp lens 4, and increase the area of the main-reflector 200, it is necessary to displace the main-reflector 200 backward B of the lamp. When the main-reflector 200 is displaced backward B of the lamp, the depth in the back and forth direction (F-B) of the lamp increases. When the depth in the back and forth direction (F-B) of the lamp increases, the length of a standing wall (a wall not involved in the light distribution control) of the main-reflector 200 also increases, thereby narrowing the range of the light distribution control, and limiting the flexibility in the light distribution design. On the other hand, the vehicle light in the second embodiment can increase the area of the first reflection surface 21, without increasing the depth in the back and forth direction (F-B) of the lamp. As a result, the vehicle light in the second embodiment can realize the improvement both in the flexibility in the light distribution design, and in the light distribution performance by the first reflection surface 21.

In the vehicle light in the second embodiment, by designating the midpoint between the sub-filament 10 and the main-filament 11 as the focal point (first focal point F1) of the first reflection surface 21, MAX luminous intensity can be easily obtained. Further, in the vehicle light in the second embodiment, by designating the substantial central point of the main-filament 11 as the focal point (second focal point F2) of the second reflection surface 22, the high-beam light distribution pattern can be easily controlled. In the vehicle light in the second embodiment, by designating the point at the end (rear end) of the sub-filament 10 closer to the main-filament 11 as the focal point (third focal point F3) of the reflection surface 30 of the sub-reflector 3, at the time of lighting the sub-filament 10, the light from the sub-filament 10 is reflected as downward reflected light by the reflection surface 30 of the sub-reflector 3. As a result, the light can be appropriately distributed up to the close side of the vehicle.

Figure 17:
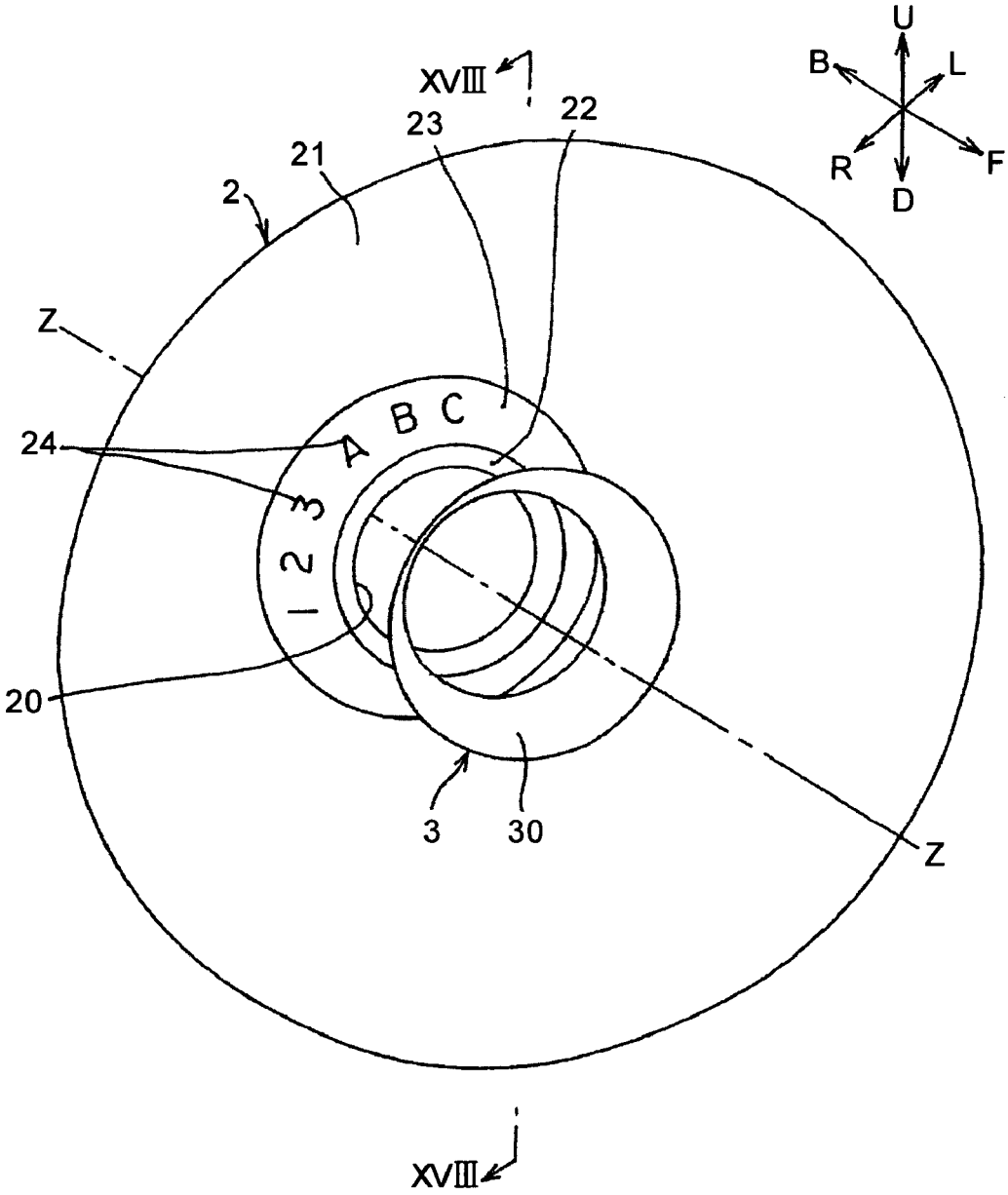
FIG. 17 is a perspective view of a main-reflector and a sub-reflector of a vehicle light according to a third embodiment of the present invention.
Figure 18:
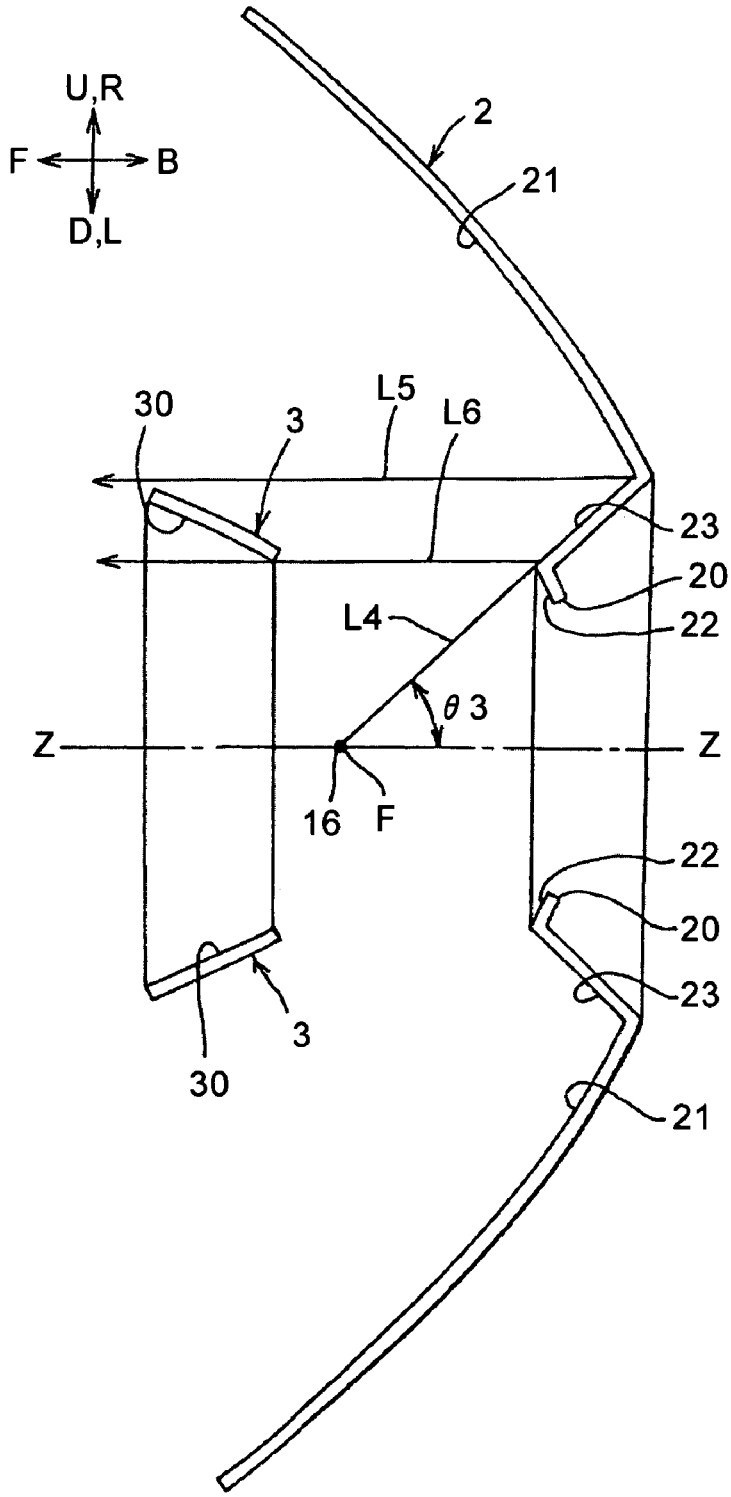
FIG. 18 is a cross section along line XVIII—XVIII in FIG. 17.

FIGS. 17 and 18 depict a vehicle light according to a third embodiment of the present invention. The vehicle light in the third embodiment will be explained below. In the drawings, like reference signs designate like parts in as those in FIGS. 1 to 16.

The main-reflector 2 of the vehicle light in the third embodiment includes the first reflection surface 21 and the second reflection surface 22, using as a base a paraboloid designating the vicinity of a light-emitting portion 16 of the light source 1 as a focal point F, and the stepped surface 23 arranged between the first reflection surface 21 and the second reflection surface 22, into which light L4 from the light-emitting portion 16 of the light source 1 does not enter. An angle θ3 between the stepped surface 23 and the optical axis Z-Z is, as shown in FIG. 18, such that the light L4 from the light-emitting portion 16 of the light source 1 does not enter into the stepped surface 23.

The sub-reflector 3 is arranged at a position between reflected light L5 from the first reflection surface 21 and reflected light L6 from the second reflection surface 22, and a position through which the reflected light L5 from the first reflection surface 21 and the reflected light L6 from the second reflection surface 22 do not pass.

Since the vehicle light in the third embodiment has the above configuration, the action and the effect similar to those of the vehicle lights in the first and the second embodiments can be achieved.

Particularly, in the vehicle light in the third embodiment, since the light L4 from the from the light-emitting portion 16 of the light source 1 can not enter into the stepped surface 23 provided between the first reflection surface 21 and the second reflection surface 22, the stepped surface 23 is not involved in the light distribution control. As a result, in the vehicle light in the third embodiment, as shown in FIG. 17, a design 24 such as a pattern, color, character, figure, or sign can be applied to the stepped surface 23, and hence, a new design or a new appearance can be obtained.

In the vehicle light in the third embodiment, the light source 1 may be a double-filament light source having a sub-filament and a main-filament, a single-filament light source, or a discharge lamp.

Figure 19:
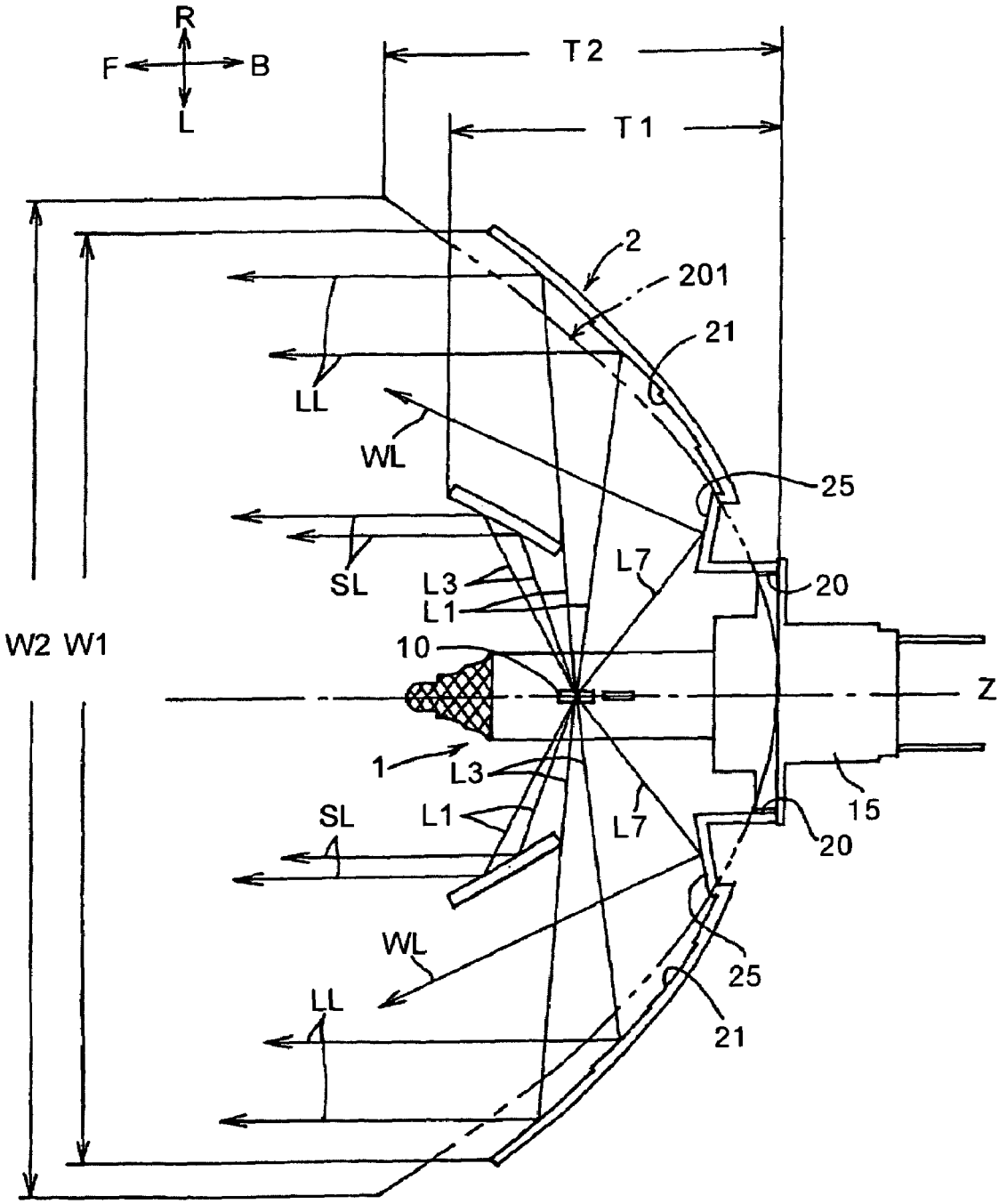
FIG. 19 is a cross-sectional view of a light source, a main-reflector, and a sub-reflector of a vehicle light according to a fourth embodiment of the present invention.

FIG. 19 depicts a vehicle light according to a fourth embodiment of the present invention. The vehicle light in the fourth embodiment will be explained below. In the drawing, like reference signs designate like parts as those in FIGS. 1 to 18.

A through-hole 20 through which the light source 1 is inserted is provided substantially at the center of the main-reflector 2 of the vehicle light in the fourth embodiment. A diffuse reflection surface 25 that forms a diffused light-distribution-pattern (not shown) is provided at the peripheral edge of the through-hole 20 of the main-reflector 2. That is, the diffuse reflection surface 25 reflects light L7 from the light source 1 as a diffused light WL. The diffuse reflection surface 25 is formed of a curved surface obtained by rotating a spheroid or a paraboloid about a predetermined axis, or a curved surface obtained by bending a paraboloid.

Since the vehicle light in the fourth embodiment has the above configuration, the action and the effect similar to those of the vehicle light in the first to the third embodiments can be achieved.

Particularly, in the vehicle light in the fourth embodiment, the light L7 from the light source 1 is reflected as a diffused light WL by the diffuse reflection surface 25 provided at the peripheral edge of the through-hole 20 of the main-reflector 2, to obtain the diffused light-distribution-pattern. As a result, the vehicle light in the fourth embodiment can use the light L7 from the light source 1 more effectively.

In the vehicle light in the fourth embodiment, the depth T1 in the back and forth direction (F-B) and the width W1 in the left and right direction (L-R) of the lamp may be smaller than the depth T2 and the width W2 of the main-reflector 201 (main-reflector shown by a two-dot chain line in FIG. 19), in which the diffuse reflection surface is not provided at the peripheral edge of the through-hole. That is, with the main-reflector 201 in which the diffuse reflection surface is not provided at the peripheral edge of the through-hole, when the light from the light source is to be used more effectively, it is necessary to increase the depth T2 and the width W2.

In the vehicle light in the fourth embodiment, the light source 1 may be a double-filament light source having a sub-filament and a main-filament, a single-filament light source, or a discharge lamp.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

This application claims priority from Japanese Patent Application 2003-402125, filed Dec. 1, 2003, which is incorporated herein by reference in its entirety.

What is claimed is:

1. A vehicle light comprising a light source, a main-reflector, and a sub-reflector, wherein the sub-reflector is arranged around the light source, the main-reflector is arranged around the light source and the sub-reflector, the main-reflector includes a reflection surface that reflects light from the light source in a predetermined direction, avoiding the sub-reflector, the light source includes a main-filament and a sub-filament, the main-reflector includes a fist reflection surface and a second reflection surface, the first reflection surface reflects light from the sub-filament as a low beam, by which a low-beam light distribution pattern is obtained, and reflects light from the main-filament as a high beam, by which a high-beam light distribution pattern is obtained, the second reflection surface reflects the light from the main-filament as a high beam, by which a high-beam light distribution is obtained, the first reflection surface is divided into a close reflection surface in a zone close to the light source and the sub-reflector, and a far reflection surface in a zone far from the light source and the sub-reflector.

2. The vehicle light according to claim 1, wherein the close reflection surface reflects the light from the sub-filament in a predetermined direction, avoiding the sub-reflector, and in the low-beam light distribution pattern, obtains at least one light distribution pattern from among a first light distribution pattern, a second light distribution pattern, and a third light distribution pattern, wherein the first light distribution pattern is a diffused light-distribution-pattern, in which a horizontal width largely protrudes to right and left sides from a vertical line on a screen, the second light distribution pattern is a substantially diffused light-distribution-pattern in which the horizontal width slightly largely protrudes to the right side from the vertical line on the screen, and slightly protrudes to the left side from the vertical line on the screen, the third light distribution pattern is a substantially diffused light-distribution-pattern in which the horizontal width slightly largely protrudes to the left side from the vertical line on the screen, and slightly protrudes to the right side from the vertical line on the screen.

3. The vehicle light according to claim 1, wherein the close reflection surface reflects the light from the sub-filament in a predetermined direction, avoiding the sub-reflector, and in the low-beam light distribution pattern, is divided into a third reflection surface, a fourth reflection surface, and a fifth reflection surface, wherein the third reflection surface is a reflection surface in a zone where a diffused light-distribution-pattern is obtained, in which a horizontal width largely protrudes to right and left sides from a vertical line on a screen, the fourth reflection surface is a reflection surface in a zone where a substantially diffused light-distribution-pattern is obtained, in which the horizontal width slightly largely protrudes to the right side from the vertical line on the screen, and slightly protrudes to the left side from the vertical line on the screen, and the fifth reflection surface is a reflection surface in a zone where a substantially diffused light-distribution-pattern is obtained, in which the horizontal width slightly largely protrudes to the left side from the vertical line on the screen, and slightly protrudes to the right side from the vertical line on the screen, and the far reflection surface, in the high-beam light distribution pattern, is divided into a sixth reflection surface, a seventh reflection surface, an eighth reflection surface, a ninth reflection surface, and a tenth reflection surface, wherein the sixth reflection surface is a reflection surface in a zone where a substantially centralized light distribution pattern is obtained, in which the horizontal width slightly largely protrudes to the left side from the vertical line on the screen, and slightly protrudes to the right side from the vertical line on the screen, the seventh reflection surface is a reflection surface in a zone where a diffused light-distribution-pattern is obtained, in which the horizontal width largely protrudes to the right and left sides from the vertical line VU-VD on the screen, the eighth reflection surface is a reflection surface in a zone where a substantially centralized light distribution pattern is obtained, in which the horizontal width slightly largely protrudes to the right side from the vertical line on the screen, and slightly protrudes to the left side from the vertical line on the screen, the ninth reflection surface is a reflection surface in a zone where a light distribution pattern forming a triangular cutline on a driving lane side is obtained, and the tenth reflection surface is a reflection surface in a zone where a light distribution pattern forming a horizontal cutline on an opposing lane side is obtained.

4. The vehicle light according to claim 1, wherein the light source and the sub-reflector are arranged close to each other, and a light distribution pattern obtained by the sub-reflector has a curved shape with respect to a high luminous intensity zone at an upper edge of a light distribution pattern obtained by the main-reflector, with a central part recessed downward, and one end and other end portions protruding upward.

5. The vehicle light according to claim 1, wherein a light distribution pattern obtained by the main-reflector is a low-beam light distribution pattern, the light source and the sub-reflector are arranged close to each other, and a light distribution pattern obtained by the sub-reflector has a curved shape with respect to a high luminous intensity zone at an upper edge of the low-beam light distribution pattern obtained by the main-reflector, with a central part recessed downward, and one end and other end portions protruding upward.

6. A vehicle light comprising a light source, a main-reflector, and a sub-reflector, wherein the sub-reflector is arranged around the light source, the main-reflector is arranged around the light source and the sub-reflector, the main-reflector is includes a reflection surface that reflects light from the light source in a predetermined direction, avoiding the sub-reflector, the light source includes a main-filament and a sub-filament, the main-reflector includes a first reflection surface and a second reflection surface of which a base is a paraboloid designating a vicinity of a light-emitting portion of the light source as a focal point, and a stepped surface arranged between the first reflection surface and the second reflection surface, the first reflection surface reflects light from the sub-filament as a low beam, by which a low-beam light distribution pattern is obtained, and reflects light from the main-filament as a high beam, by which a high-beam light distribution pattern is obtained, the second reflection surface reflects light from the main-filament as the high beam, by which the high-beam light distribution pattern is obtained, and the focal length of the first reflection surface is longer than that of the second reflection surface.

7. A vehicle light comprising a light source, a main-reflector, and a sub-reflector, wherein the sub-reflector is arranged around the light source, the main-reflector is arranged around the light source and the sub-reflector, the main-reflector is includes a reflection surface that reflects light from the light source in a predetermined direction, avoiding the sub-reflector, the main-reflector includes a first reflection surface and a second reflection surface of which a base is a paraboloid designating a vicinity of a light-emitting portion of the light source as a focal point, and a stepped surface arranged between the first reflection surface and the second reflection surface into which the light from the light source does not enter; and the sub-reflector is arranged at a position between the light reflected from the first reflection surface and the light reflected from the second reflection surface, which is a position through which the light reflected from the first reflection surface and the light reflected from the second reflection surface do not pass.

8. The vehicle light according to claim 1, wherein a through-hole through which the light source is inserted is provided substantially at a center of the main-reflector, and a diffuse reflection surface that forms a diffused light-distribution-pattern is provided at a peripheral edge of the through-hole on the main-reflector.

9. A vehicle light comprising a light source, a main-reflector, and a sub-reflector, wherein the sub-reflector is arranged around the light source, the main-reflector is arranged around the light source and the sub-reflector, the main-reflector is includes a reflection surface that reflects light from the light source in a predetermined direction, avoiding the sub-reflector, the light source includes a main-filament and a sub-filament, the main-reflector includes a first reflection surface and a second reflection surface, the first reflection surface includes a reflection surface of which a base is a paraboloid designating a substantial midpoint between the main-filament and the sub-filament as a focal point, which reflects light from the sub-filament as a low beam, by which a low-beam light distribution pattern is obtained, and reflects light from the main-filament as a high beam, by which a high-beam light distribution pattern is obtained, the second reflection surface includes a reflection surface of which a base is a paraboloid designating a substantial central point of the main-filament as a focal point, which reflects light from the main-filament as a high beam, by which a high-beam light distribution pattern is obtained, and the sub-reflector includes a reflection surface of which a base is a paraboloid designating a point at an end of the sub-filament closer to the main-filament as a focal point.

* * * * *